United States Patent [19]

Rapids

[11] 4,035,246

[45] July 12, 1977

[54] METHOD AND COMPOSITIONS FOR ELECTROPLATING COPPER AND BRASS

[75] Inventor: Felix R. Rapids, Chicago, Ill.

[73] Assignee: Rapid Electroplating Process, Inc., Chicago, Ill.

[21] Appl. No.: 691,880

[22] Filed: June 1, 1976

[51] Int. Cl.[2] ..... C25D 5/02; C25D 5/06; C25D 3/38

[52] U.S. Cl. ..... 204/15; 204/52 R; 204/224 R

[58] Field of Search ..... 204/15, 224 R, 52 R, 204/DIG. 2, 44

[56] References Cited

U.S. PATENT DOCUMENTS

| | | | |
|---|---|---|---|
| 3,746,627 | 7/1973 | Rapids | 204/15 |
| 3,755,089 | 8/1973 | Rapids | 204/15 |
| 3,798,138 | 3/1974 | Ostrow et al. | 204/52 R |
| 3,923,613 | 12/1975 | Immel | 204/52 R |

OTHER PUBLICATIONS

Modern Electroplating, Frederick Lowenheim, 1963 pp. 158–167.

*Primary Examiner*—T. M. Tufariello
*Attorney, Agent, or Firm*—Hill, Gross, Simpson, Van Santen, Steadman, Chiara & Simpson

[57] ABSTRACT

An improved method of plating a workpiece with brass or copper which involves first applying an aqueous solution containing Rochelle salt, an alkali metal carbonate, and a surfactant to the workpiece without electrical current being applied, and thereafter rubbing the same solution into the workpiece while applying an electroplating current between a brass or copper anode and the workpiece. The invention is also concerned with the compositions used as electrolytes in this process.

8 Claims, 3 Drawing Figures

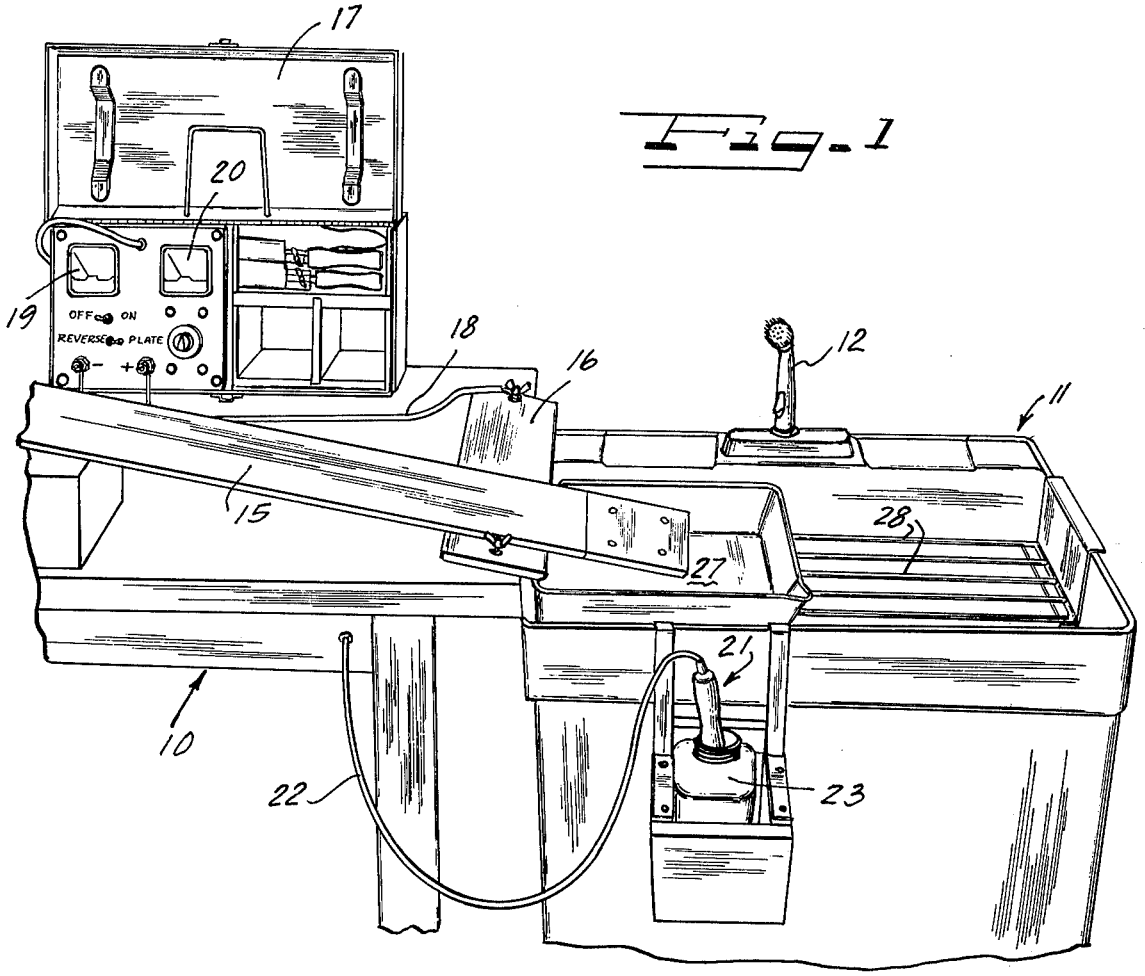
Fig. 1
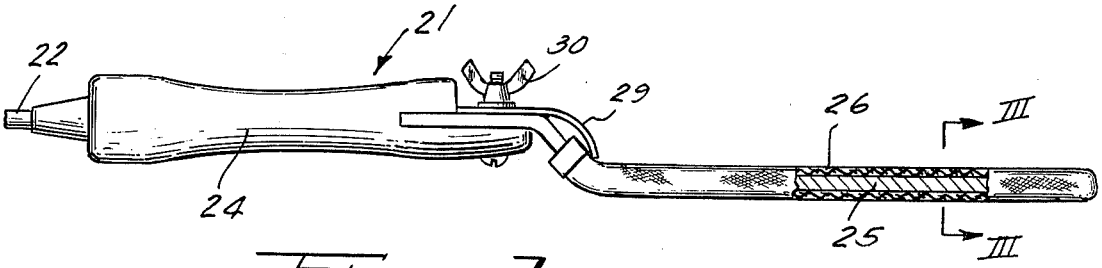
Fig. 2
Fig. 3
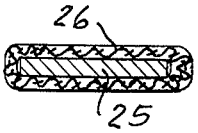

METHOD AND COMPOSITIONS FOR ELECTROPLATING COPPER AND BRASS

BACKGROUND OF THE INVENTION

1. Field of the Invention

This invention is in the field of portable electroplating wherein a brass or copper anode is covered with a fluid absorptive sleeve which has been immersed in an electrolyte and then an electroplating current is applied between the brass or copper anode and the workpiece to therby deposit a plating at selected areas of the workpiece.

2. DESCRIPTION OF THE PRIOR ART

The present invention represents an improvement over the type of method described and claimed in my previous U.S. Pat. No. 3,746,627. In this patent, there is described a method of metal electroplating for depositing a localized plating on an electrically conductive portable member. The workpiece to be plated was removably positioned on an electrically conductive current carrying cathode bar. The contact area to be plated was rubbed with a plating electrolytecarrier to wet the area with the electrolyte and build up a plated layer thereon.

The present invention may utilize the type of method and apparatus described in the aforementioned U.S. Pat. No. 3,746,627 but makes use of an improved electrolyte. Heretofore, electrolytes for portable plating frequently used corrosive materials such as sulfuric acid, sodium or potassium hydroxide, sodium or potassium cyanides, and the like. The use of such hazardous chemicals made it necessary to provide safeguards for operating personnel to prevent contact with the chemicals. It was also necessary to use specialized, expensive containers for handling and shipping the chemicals which necessarily increased the cost. Since many of these materials also gave off noxious fumes, pollution control of the atmosphere was a problem.

SUMMARY OF THE INVENTION

The present invention provides a system which meets safety requirements for workers as set forth by OSHA. The electrolyte has no corrosive or noxious materials or heavy metal ions so that it can be shipped without limitation by air, land or sea. Since no noxious fumes are given off, no elaborate pollution control equipment is necessary.

The improved electrolyte of the present invention consists of an aqueous solution containing, for each 16 fluid ounces (473 ml) of water, from 28 to 85 grams of Rochelle salt, from 14 to 57 grams of potassium carbonate, and from 0.30 to 0.60 milliliter of a surfactant. The aqueous solution is first rubbed on the work with the plating applicator, without, however, any electroplating current being applied. This initial treatment with the electrolyte serves to condition the surface of the workpiece for the subsequent plating step. As in the case of my aforementioned U.S. Pat. No. 3,746,627, I make use of a plating electrode which is encased in a fluid absorptive sleeve. The sleeve is then redipped into the electrolyte and the electrolyte is applied with a rubber action to the work while plating current is impressed. The metal flows from the copper or brass anode through the solution on the sleeve to the workpiece at a relatively low voltage, and at current densities ranging from a few amperes to thousands of amperes per square foot in small areas. The current is sufficient in the case of heavy plating to cause volatilization of some of the aqueous electrolyte as steam.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications might be effected without departing from the spirit and scope of the novel concepts of the disclosure, and in which:

FIG. 1 illustrates an apparatus suitable for carrying out the method of the present invention;

FIG. 2 is a view of the applicator element alone; and

FIG. 3 is a cross-sectional view taken along the line III–III of FIG. 2.

DESCRIPTION OF THE PREFERRED EMBODIMENTS

As shown in FIG. 1, an apparatus suitable for use in carrying out the method of the present invention may include a bench 10 and a sink 11 having a spray device 12 for supplying rinse water to the sink.

A workpiece 15 composed of cold rolled steel, or the like, is positioned on a cathode bar 16 which is connected to the negative side of a power supply 17 by means of a cable 18. The power supply 17 also includes the usual voltmeter 19 and an ammeter 20. The free end of the workpiece 15 is positioned over a tray 27 located in the sink 11 and movable on bars 28. The function of the tray 27 is to catch any drippings that might flow from the end of the workpiece before or during plating.

A plating electrolyte carrier generally identified at reference numeral 21 is illustrated more completely in FIGS. 2 and 3 of the drawings. The carrier 21 is connected by means of a cable 22 to the positive side of the power supply 17. The electrolyte carrier 21 can be received in a jar 23 located below the level of the sink 11, the jar being partially filed with the improved electrolyte solution of the present invention.

As illustrated in FIG. 2, the plating electrolyte carrier includes a handle 24 and an offset rectangular portion 25 which is covered by a liquid absorptive sleeve 26. A clamp 29 presses an end of the sleeve 26 against the electrode at a clamping pressure adjusted by means of a wing nut 30. The sleeve can be made of any suitable fabric such as cotton or "Dynel"or similar material which is relatively inert to the electrolyte and that is porous or otherwise permeable to or absorptive of the electrolyte and capable of retaining the electrolyte in the interstices provided by the woven or unwoven strands of the encasing fabric. The fabric has a nap side in contact with the anode metal.

The electrolyte which is free of metallic ions has a composition within the following ranges:

Water; 16. fl. oz. (473 ml.)

Rochelle salt; 1–3 oz. (28–85 g.)

Alkali metal carbonate (calculated as $K_2CO_3$); 0.5–2 oz. (14–57 g.)

Surfactant; 5–10 minims (0.30 to 0.60 ml.)

The preferred alkali metal carbonate is potassium carbonate.

Many different types of surfactants can be used, but I prefer to use a normally liquid, non-ionic surfactant which wets the surface and adheres thereto as a film. I particularly prefer to use ethoxylated alkyl phenols, such as those being marketed under the "Triton,"particularly "Triton X-100 "which is an alkyl phenol ethoxylated with about 8 molecules of ethylene oxide. This material is sold as a syrupy liquid containing 100 % active ingredient. Other surfactants can, however, be used including ethoxylated alcohols, alkyl amide condensates, and the like, all of which are non-ionic. Suitable anionic agents include sulfonated alcohols such as the "Nacconols"alkyl aryl sufonates, dialkyl esters of sodium sulfosuccinate, alkyl aryl sulfonic acids, and sulfated esters such as lauryl sulfate.

In using the process of the present invention, the applicator sleeve is mounted on a copper or brass anode depending upon which metal is to be plated. The sleeve covered anode is then immersed into the solution of electrolyte contained in the jar 23. The portion of the workpiece which is to be plated is then treated with the electrolyte laden sleeve, with rubbing but without any electroplating current being turned on. This preliminary treatment conditions the metal for subsequent reception of the plating. The plating current is then turned on, after the sleeve 26 has again been immersed in the electrolyte solution and the electroplating proceeds with a rubbing action of the applicator on the workpiece 15. Optimum heavy plating results are achieved when sufficient current passes through the workpiece to cause volatilization of at least some of the aqueous solution as steam. Steam liberation is not observed for light plating. After plating, the work can be rinsed with water and wiped dry. Typical plating voltages are on the order of 6 to 12 volts. At such voltages one can expect a coating of about ½ mil/4 square inches for a plating time of 40 to 50 seconds.

The following is an example of a particularly preferred electrolyte composition:

Water; 16 fl. oz. (473ml.) ml.)
Rochelle salt; 2 oz. (56g.)
Potassium carbonate; 1 oz. (28g.)
"Triton X-100"7 minims (0.42ml.)

From the foregoing it will be understood that the present invention provides an improvement in the art of portable electroplating for plating specific areas on small or large parts in the shop, in the field, or on production lines. The use of the improved system meets essential safety requirements for workers and the electrolyte is such that it can be shipped without restriction. No pollution control is required and expensive pressurized containers for corrosive electrolytes are no longer required.

It should be evident that various modifications can be made to the described embodiments without departing from the scope of the present invention.

I claim as my invention:

1. The method of plating a workpiece with brass or copper which comprises applying an electrolyte consisting essentially of an aqueous solution containing Rochelle salt, an alkali metal carbonate, and a surfactant to said workpiece without electrical current being applied, said electrolyte being substantially free from acids, alkalis, and cyanides, and thereafter rubbing said solution onto said workpiece while applying an electroplating current between a brass or copper anode and said workpiece.

2. The method of claim 1 in which said anode is encased in a fluid absorptive sleeve.

3. The method of claim 1 in which said surfactant is a non-ionic surfactant.

4. The method of claim 1 in which said alkali metal carbonate is potassium carbonate.

5. The method of claim 1 in which said solution contains for each 16 fluid ounces (473 ml.) of water, from 28 to 85 grams of Rochelle salt, from 14 to 57 grams of potassium carbonate, and from 5 to 10 minims (0.30 to 0.60 ml.) of surfactants.

6. An electrolyte for copper or brass plating comprising an aqueous solution consisting essentially of for each 16 fluid ounces (473 ml.) of water, from 28 to 85 grams of Rochelle salt, from 14 to 57 grams of potassium carbonate, and from 0.30 to 0.60 ml. of a non-ionic surfactant.

7. An electrolyte as claimed in claim 6 in which said surfactant is an ethoxylated alkyl phenol.

8. An electrolyte as claimed in claim 6 in which said non-ionic surfactant is liquid at room temperature.

* * * * *